United States Patent [19]

Hanson

[11] 4,112,058

[45] Sep. 5, 1978

[54] PRODUCTION OF CARBON MONOXIDE FROM CARBONACEOUS MATERIAL AND ZINC OXIDE

[75] Inventor: Donald O. Hanson, Bartlesville, Okla.

[73] Assignee: Phillips Petroleum Company, Bartlesville, Okla.

[21] Appl. No.: 716,402

[22] Filed: Aug. 23, 1976

[51] Int. Cl.[2] ..... C01B 31/18

[52] U.S. Cl. ..... 423/415 A; 423/622; 423/623; 75/86; 75/88; 48/197 R

[58] Field of Search ..... 423/415 A, 622, 623, 423/107; 75/86–88; 48/196 R, 197 R; 165/107, DIG. 12

[56] References Cited

U.S. PATENT DOCUMENTS

| | | | |
|---|---|---|---|
| 799,743 | 9/1905 | Mackay | 75/88 |
| 1,899,184 | 2/1933 | de Simo | 48/196 R |
| 2,041,237 | 5/1936 | Feuer et al. | 423/623 |
| 2,333,845 | 11/1943 | Danforth | 165/107 X |
| 2,342,368 | 2/1944 | Queneau | 75/88 X |
| 2,602,809 | 7/1952 | Dickinson | 423/415 A |
| 2,844,453 | 7/1958 | Kapp et al. | 423/415 A |
| 3,968,833 | 7/1976 | Strindehag et al. | 165/107 X |

*Primary Examiner*—Earl C. Thomas

[57] ABSTRACT

A carbon source and zinc oxide are reacted in a reactor to form a gas consisting essentially of carbon monoxide and zinc. The zinc is separated and reoxidized in a zinc oxidizer. In the reactor and the zinc oxidizer, heat exchange means are provided for that are connected to each other to form a heat exchange loop through which a heat exchange fluid is circulated such as to supply heat generated in the zinc oxidizer to the reactor.

8 Claims, 2 Drawing Figures

PRODUCTION OF CARBON MONOXIDE FROM CARBONACEOUS MATERIAL AND ZINC OXIDE

This invention relates to the production of carbon monoxide. More specifically this invention relates to the gasification of solid or heavy liquid carbon sources. A further aspect of this invention is the gasification of carbon sources in the absence of air.

BACKGROUND OF THE INVENTION

The conversion of solid carbon sources to a gas has been developed many years ago. One process known as coal gasification contacts coal and steam under elevated temperature conditions to produce a gas consisting essentially of carbon monoxide and hydrogen, also called synthesis gas. The coal gasification processes are of great interest since they generally have the advantage of providing the potential of an environmentally clean process for coal utilization, of producing a high heating value gas which can substitute for natural gas or of producing a low heating value gas suitable for use as synthesis gas or subsequent conversion to hydrocarbons or chemicals or as boiler fuel.

The introduction of air in a coal gasification process is generally undesirable since large volumes of nitrogen have to be handled in the process. It would, therefore, be desirable to have a process available which uses a different oxygen source than air for the conversion of the carbon source into carbon monoxide. In addition, since the carbon monoxide forming reaction is generally an endothermic reaction, it would be desirable to have means available by which the heat necessary for this carbon monoxide forming reaction can be at least partially furnished from another process step such as to reduce the heat consumption in the process to a minimum.

THE INVENTION

It is therefore one object of this invention to provide a process for the production of carbon monoxide.

Another object of this invention is to provide a process for the production of carbon monoxide from carbon sources essentially in the absence of air.

A further object of this invention is to provide a process for the production of carbon monoxide from solid carbon sources and solid oxygen donor materials in which the reduced oxygen donor can be readily reoxidized and recycled, and wherein the heat developed during the reoxidation step of the oxygen donor is effectively transferred to the carbon monoxide forming step.

These and other objects, advantages, details, features and embodiments of this invention will become apparent to those skilled in the art from the following detailed description, the appended claims and the drawing, in which FIGS. 1 and 2 each show a schematic flow diagram for the process of this invention.

In accordance with this invention, there is provided an improvement in a process for the production of carbon monoxide in which a carbon source and zinc oxide are converted in a reactor into a gas comprising carbon monoxide and zinc, and wherein the zinc separated from the gas produced in this reactor is reoxidized in a zinc oxidizer to zinc oxide. In accordance with this improvement, a heat exchange loop comprising indirect heat exchange means in the reactor, as well as indirect heat exchange means in the zinc oxidizer, connected to each other to form the heat exchange loop is provided for. In this heat exchange loop, a heat exchange fluid is circulated such as to transfer heat generated in the zinc oxidizer to the reactor in which the endothermic reaction between the carbon source and zinc oxide takes place. The zinc oxide produced in the zinc oxidizer preferably is introduced into the reactor for further reaction with the carbon source.

Many heat exchange fluids are useful for the purposes of this invention. Particularly useful heat exchange fluids in accordance with this invention are those that can be readily kept liquid under the temperature of the carbon monoxide forming reaction between the carbon source and the zinc oxide and that can be kept in vapor phase at the temperature of the zinc oxidation. Molten metals and salts can be used. The preferred group of heat exchange fluids consists of zinc, sodium, potassium and mixtures of sodium and potassium. The pressures under which the heat exchange loops are preferably operated to achieve the advantageous result that these fluids are liquid at the temperature of the carbon monoxide forming reaction and in vapor phase at the temperature of the zinc oxidation are given in the following table:

| Heat Exchange Fluid | Pressure Range | |
|---|---|---|
| | psia | kPa |
| Zn | 25–50 | 170–345 |
| Na | 25–50 | 170–345 |
| K | 80–130 | 550–895 |
| Na + K (50/50 weight ratio) | 40–100 | 275–690 |

The units kPa are the metric pressure units kilo pascals. The preferred heat exchange fluid is zinc. To use this metal is particularly advantageous since it is totally compatible with every stage of the overall process. Thus small leaks in the heat exchange loop which might occur in the main reactor in which the carbon monoxide is formed or in the zinc oxidizer do not substantially influence the performance or result of the overall process.

Further features which individually or in combination with each other constitute preferred embodiments of this invention are described in the following.

The heat exchange fluid flowing from the heat exchange means in the zinc oxidizer to the heat exchange means in the reactor can be passed through a third heat exchange means and into indirect heat exchange relationship with at least a portion of the zinc separated from the gas withdrawn from the reactor. The third heat exchange means serve, e.g., to completely evaporate liquid zinc before the further use thereof.

The zinc stream that is separated from the gas leaving the reactor is generally present as a liquid having a temperature lower than but near the boiling point of zinc. Preferably this liquid zinc is vaporized before it is further used. For achieving this a part or all of the liquid zinc can be passed into indirect heat exchange relationship with the gas withdrawn from the reactor and/or with the heat exchange fluid flowing from the heat exchange means arranged in the zinc oxidizer to the heat exchange means arranged in the reactor and/or with an extraneous heating fluid.

In case a completely separated heat exchange loop between the reactor and the zinc oxidizer is used, the liquid zinc stream separated from the gas leaving the reactor preferably is passed through indirect heat exchange relationship with the gas leaving the reactor and thereafter with the heat exchange fluid leaving the heat exchange means arranged in the zinc oxidizer.

The stream of evaporated zinc is introduced into the zinc oxidizer to be oxidized to zinc oxide. Optionally a carrier portion of this zinc vapor stream, instead of being introduced into the zinc oxidizer, can be injected into the line for transporting the zinc oxide of the zinc oxidizer to the reactor. Also optionally, a fluidizing portion of this zinc vapor stream can be injected into the lower portion of the reactor such as to fluidize the reaction mixture comprising a solid carbon source and the solid zinc oxide.

If zinc itself is the heat exchange fluid in the heat exchange loop, the preferred heat exchange loop between the reactor and the zinc oxidizer is not completely separated from the other process. For this embodiment it is preferred to separate liquid zinc at two stages from the gas leaving the reactor such as to form a first and a second liquid zinc stream. Each of these separation stages is generally carried out by passing the gas through a condenser and separator. The first liquid zinc stream is split into an oxidizer portion and a carrier portion. The oxidizer portion is conducted through an evaporator into the zinc oxidizer. The carrier portion is combined with a circulating heat exchange zinc fluid and passed therewith through the heat exchange means in the zinc oxidizer. Essentially the same quantity of zinc as added to the heat exchange zinc fluid loop is withdrawn therefrom downstream of the heat exchange means associated with the zinc oxidizer and before the zinc enters the heat exchange means in the reactor. The separated zinc vapors are used as the carrier gas for carrying the zinc oxide from the zinc oxidizer to the reactor. The second liquid zinc stream is passed into indirect heat exchange relationship with the gas leaving the reactor such as to evaporate this second liquid zinc stream. The resulting zinc vapor stream eventually after compression is also passed into the zinc oxidizer.

The carbon source in the main reaction can be any carbon-containing material that will react with zinc oxide under elevated temperature conditions to form carbon monoxide and zinc. Preferably, however, the carbon source is a solid carbon source or a heavy liquid carbon source. Examples for such a carbon source are coal, coke, char, residual oils, tar and asphalt. Solid carbon sources, i.e., carbonaceous materials remaining solid at the elevated reaction temperature conditions, such as coal, coke and char are the presently most preferred carbon source materials. The process of the present invention is in particular applicable to the gasification of char which is the solid residue of several coal gasification or pyrolysis processes such as the COED process, the Garrett process, the Synthane process and the Toscoal process.

The solid carbon source materials are used in finely divided form in order to achieve as good and as much contact with the zinc oxide oxygen donor as possible. Preferably, the solid carbon source materials will have a particle size of less than about 0.35 mm. The particle size refers to the longest extension of the individual particles.

The oxygen donor in the main reaction is zinc oxide (ZnO). This commercially available material is used in finely divided form, usually as a powder. The particle size distribution of the zinc oxide preferably is such that all the particles are in the range of 0.2 to 5 microns in diameter. Smaller particles also can be utilized. Larger particles, whereas they can be utilized, have the tendency of slowing the reaction down and, therefore, are less desirable.

The carbon source and the zinc oxide are utilized in a quantity expressed as the equivalent ratio of zinc oxide to carbon in the range of 0.9 to 1.2. Preferably, about 1.0 mol of zinc oxide per gram atom of available carbon in the carbon source is utilized.

The reaction conditions for the main reaction of the carbon with zinc oxide are not critical and preferably as defined in the following. It is particularly desirable to operate at a temperature above the boiling point of zinc so that the reaction results in a gaseous effluent consisting essentially of carbon monoxide and zinc from which zinc can be readily removed and reoxidized utilizing the heat of oxidation to at least partially supply the heat necessary for maintaining the main reaction. This main reaction is, therefore, preferably carried out at a reaction temperature between 1665° F and 2800° F (910°–1540° C). Even more preferred is a temperature range of 1850° to 2150° F(1010°–1176° C) if zinc sulfide is to be retained in the ash; 2200–2500° F (1205–1372° C) if zinc sulfide is to be vaporized.

The pressure conditions for the main carbon monoxide forming reaction are also not critical. Generally, the reaction between the carbon source and the zinc oxide is carried out at slightly superatmospheric pressure. If desired, however, the reaction can be carried out at higher pressures and high-pressure carbon monoxide can be produced.

The time of the reaction is correlated to the temperature and pressure conditions used. Generally, the time of reaction between the carbon source and the zinc oxide is determined essentially by economic reasons. The reaction is faster at higher temperatures so that the reaction time generally is shorter the higher the reaction temperature is. Preferably, therefore, the reaction time will be 5 to 120 minutes for a reaction temperature in the range of 2800° to 1670° F (1540°–910° C).

In the process of this invention a carbon source containing a considerable quantity of sulfur can be utilized. Advantageously, the process produces no volatile sulfur by-products. Zinc sulfide is produced during the reaction from the sulfur and the carbon source. This zinc sulfide can be removed by standard roasting techniques from the ash. The zinc sulfide also can be withdrawn with the gaseous effluent if the reaction temperature of the main reaction between the carbon source and the zinc oxide is at a temperature above the sublimation temperature of zinc sulfide which is 2165° F (1185° C). Zinc sulfide in this case is recovered from the gaseous effluent by subliming it on a "cold" wall having a temperature well above the boiling point of zinc and well below the sublimation temperature of zinc sulfide.

In the zinc oxidizer zinc is combusted with an oxygen source in an exothermic reaction to form ZnO. Examples of such oxygen sources are air, steam, oxygen enriched air, oxygen. Air is the preferred oxygen source. Generally the oxygen source is used in quantities above the stoichiometric requirement. Preferably about 1.05 to about 1.25 atoms of available oxygen per atom of Zn are utilized in the oxidation mixture of Zn and the oxygen source.

The invention will still be more fully understood from the description of the drawing and the calculated example.

Figure 1:
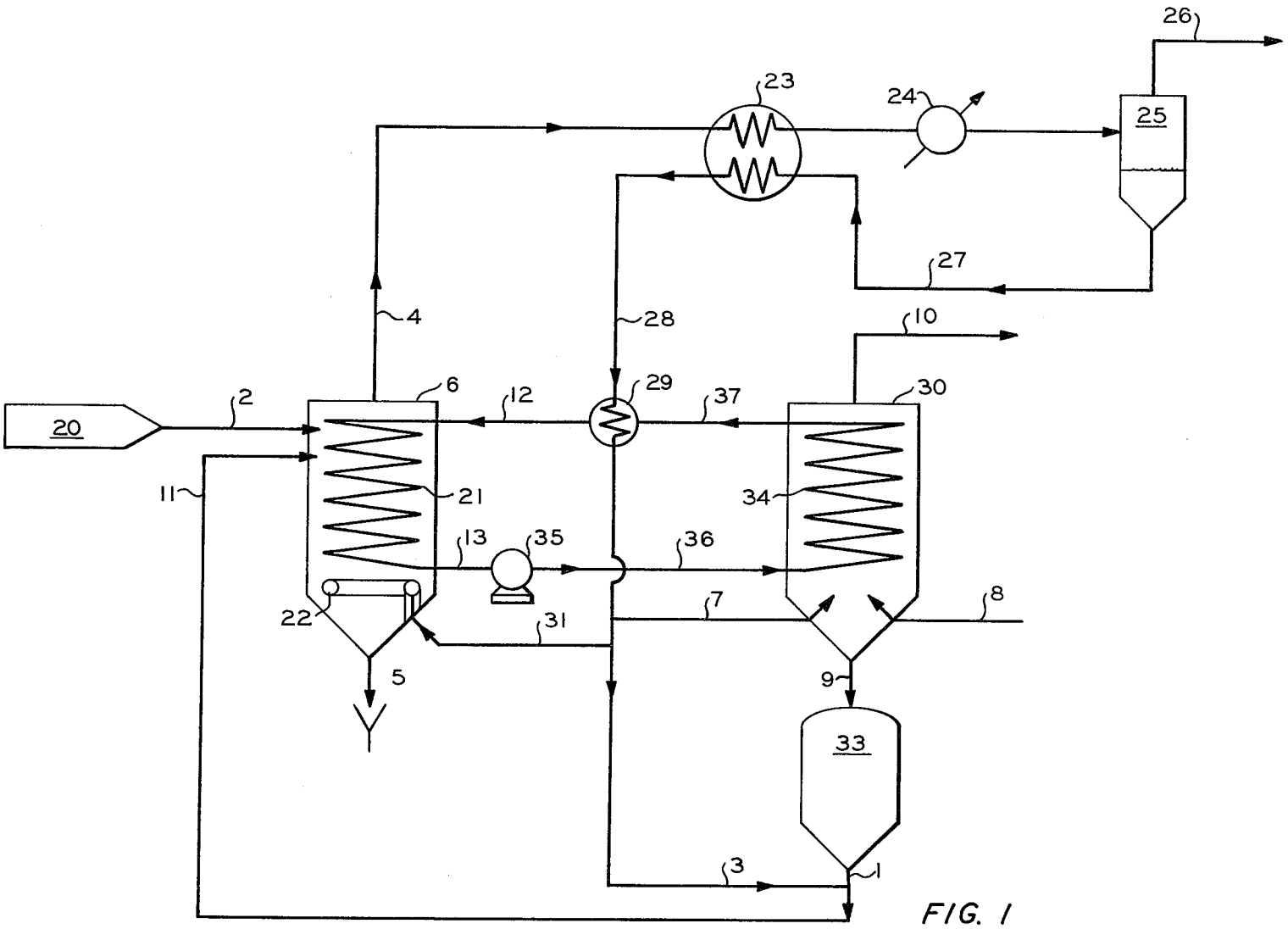
FIG. 1 is a schematic flow diagram depicting one embodiment of the invention wherein a closed heat exchange loop is utilized.

In FIG. 1 a schematic flow diagram for the process of this invention with a completely separated heat exchange loop is shown. Into a reactor 6 a carbon source from a carbon source supply 20 is introduced via line 2. Zinc oxide is also introduced into the main reactor 6 via line 11. The main reactor 6 is equipped with a first indirect heat exchange coil 21. The reaction mixture in the reactor 6 is fluidized by zinc vapors injected into the reactor via a fluidizing ring 22. The reaction of the carbon source with the zinc oxide produces a gaseous effluent that is withdrawn via line 4 from the reactor 6 and comprises carbon monoxide and zinc. The reaction also produces a solid residue comprising ash which is withdrawn via line 5 from the bottom of the reactor 6. The gaseous effluent is passed through a heat exchanger 23 and a condenser 24 to a gas liquid separator 25. From this gas liquid separator 25 a gas comprising carbon monoxide essentially free of zinc is withdrawn via line 26. From the bottom of the gas liquid separator 25 a liquid zinc stream is withdrawn via line 27. This liquid stream withdrawn via line 27 from the separator 25 is passed through the heat exchanger 23 into indirect heat exchange relationship with the gas withdrawn via line 4 from the reactor 6. Thus this gas wall is cooled and the zinc is at least partially condensed and the liquid zinc in line 27 is heated and at least partially evaporated.

The zinc stream leaving the heat exchanger 23 is passed via line 28 to an indirect heat exchanger 29 in which the zinc is completely evaporated by indirect heat exchange with the heat exchange fluid circulating in the heat exchange loop explained in the following. This evaporated zinc stream leaving the heat exchanger 29 is split in three ways. The main portion is passed via line 7 into a zinc oxidizer 30. A second or carrier portion is passed via line 3 into contact with the zinc oxide in line 1 and this zinc vapor stream carries the zinc oxide via line 11 back into the reactor 6. A third or fluidizing portion of the zinc vapor is passed via line 31 into the ring 22 from which it is injected in upward direction into contact with the solid materials in reactor 6, such as to fluidize them.

The zinc vapor stream introduced via line 7 into the oxidizer 30 is contacted with an oxidizing agent introduced via line 8 into the oxidizer 30. This oxidizing gent can be any suitable oxidizing agent that converts zinc into zinc oxide in an exothermic reaction and is preferably air or steam. In this zinc oxidizer 30, solid zinc oxide in finely divided form is produced and accumulated in the bottom of the zinc oxidizer 30 from which it is transferred via line 9 into a zinc oxide surge tank 33. A gaseous effluent, consisting essentially of nitrogen in case air is used as the oxidizing agent, leaves the zinc oxidizer 30 via line 10.

In accordance with this invention, a closed heat exchange loop between the reactor 6 and the zinc oxidizer 30 is provided for. In the zinc oxidizer a second heat exchange coil 34 is arranged that is connected into a loop with the first heat exchange coil 21 in reactor 6 via a pump 35. Part of this heat exchange loop is the heat exchanger 29. In the coil 34 a heat exchange fluid that is preferably a liquid metal introduced via line 36 is evaporated by the heat developed during the zinc oxidation taking place in the zinc oxidizer 30. The evaporated heat exchange fluid is passed via line 37 through heat exchanger 29 and via line 12 into the first heat exchange coil 21. In this coil the heat exchange fluid is condensed and delivers both the latent heat and the sensible heat to the carbon monoxide forming reaction in reactor 6. The liquid heat exchange fluid is withdrawn from this coil 21 via line 13 and is recycled to coil 34 by means of pump 35.

In the heat exhange loop comprising the heat exchange coils 21 and 34, zinc or any other heat exchange fluid can be utilized. The heat exchange loop may contain a heat balance heat exchanger that is not shown in the drawing. This heat balance heat exchanger serves to add or remove heat such as to maintain the system in heat and temperature balance. In the flow diagram shown in FIG. 2, on the other hand, zinc has to be used as the heat exchange fluid in the heat exchange loop since the system is not a closed loop heat exchange but there is a flow of zinc into the heat exchange loop and out of this loop as will be explained.

Figure 2:
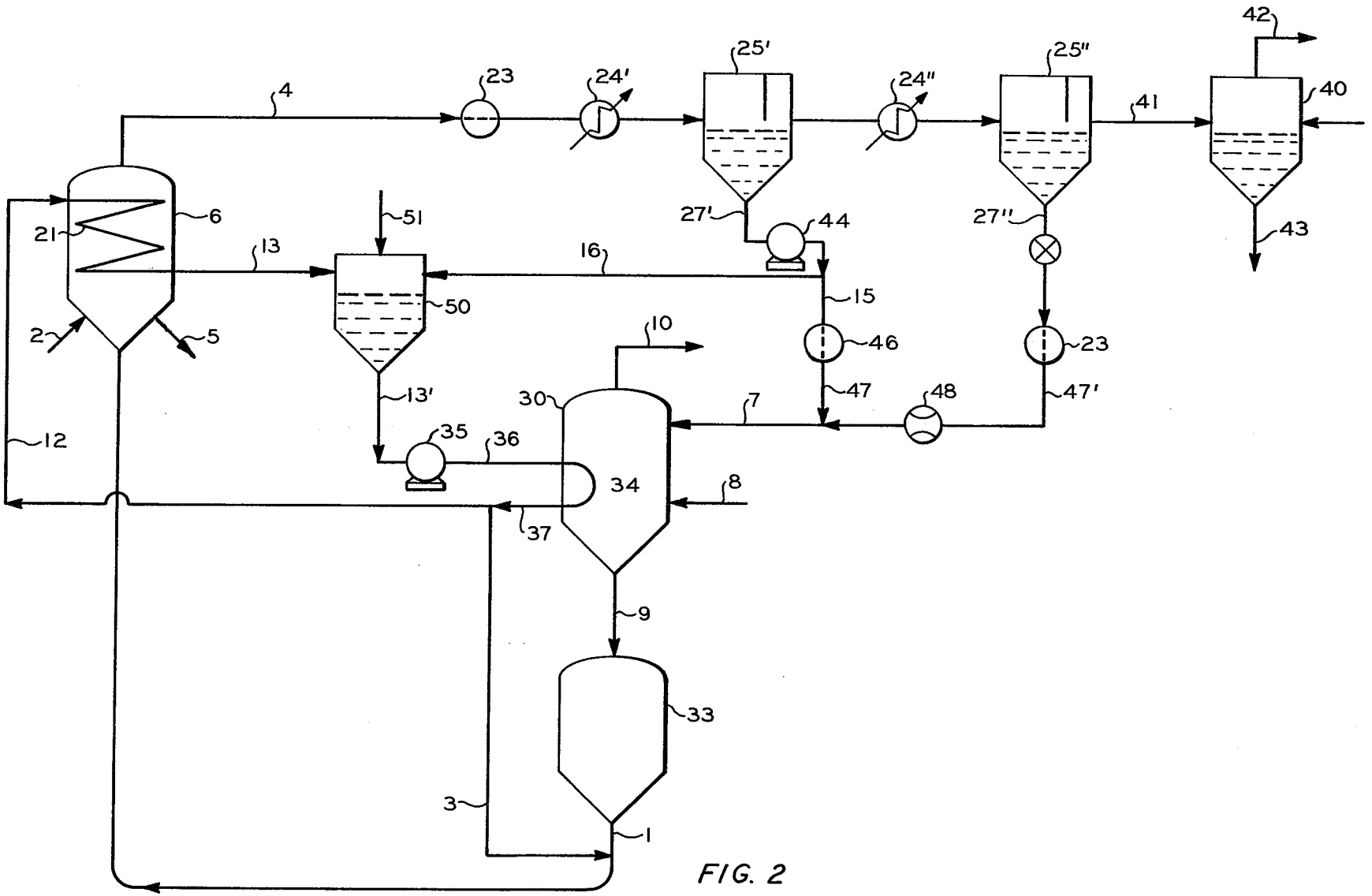
FIG. 2 is a schematic flow diagram depiction another embodiment of the invention wherein zinc is utilized as the heat exchange medium in an enclosed heat exchange loop.

The basic system shown in FIG. 2 is the same as that in FIG. 1 and the description thereof can therefore be avoided. The same numerals refer to the same elements. The gas leaving the reactor 6 via line 4 is passed through the heat exchanger 23, the two heat exchange paths of which are shown at different locations in the drawing. It is, of course, to be understood that these two portions of the heat exchanger 23 are in reality in close contact with each other so that the heat exchange between the liquid zinc stream and the gas can be achieved. The gas leaving the heat exchanger 23 is passed through a first condenser 24' and a first gas/liquid separator 25'. The gas leaving the first gas/liquid separator 25' is passed through a second condenser 24'' and a second gas/liquid separator 25''. The gas leaving this second gas/liquid separator 25'' finally is passed to a water quench and washing unit 40 via line 41 in which this gas stream is quenched and washed with water such as to cool the gas and to remove traces of zinc. The carbon monoxide-comprising gas leaves the water quench and washing unit 40 via line 42 and water-containing traces of zinc leaves the unit 40 via line 43. The liquid zinc stream leaving the bottom of the first gas/liquid separator 25' via line 27' is pumped via pump 44 for further processing. This liquid zinc stream leaving the pump 44 is split into an oxidizing portion in line 15 and a carrier portion in line 16.

The liquid zinc in line 15 is passed through an evaporator 46. The evaporator 46 may receive its heat by being submerged in oxidation reactor 30. Similarly, the liquid zinc stream in line 27'', having passed through the heat exchanger 23 in indirect heat exchange relationship with the gas leaving the reactor 6 via line 4, leaves this heat exchanger 23 as a zinc vapor. The two zinc vapor streams in lines 47 and 47' are combined in line 7 and injected into the zinc oxidizer 30. The zinc vapor stream in line 47' is passed through a zinc vapor compressor 48 so that both zinc vapor streams in lines 47 and 47' are at the same pressure.

The carrier portion of the liquid zinc stream in line 16 is passed into a liquid zinc vessel 50. The liquid zinc leaving the heat exchange coil 21 is also passed into this vessel 50. Furthermore, makeup zinc is introduced into this vessel 50 via line 51. The liquid zinc is removed from this vessel via line 13' by pump 35 and passed through the heat exchange coil 34 via line 36. From the zinc vapor stream leaving the heat exchange coil 34 in line 37, a carrier portion is withdrawn via line 3. The quantity of zinc vapor withdrawn via line 3 from the heat exchange loop is essentially the same as the sum of the zinc streams introduced into the liquid zinc vessel 50 via lines 51 and 16. The zinc vapor stream in line 3 serves as a carrier gas for carrying the zinc oxide from zinc oxide surge tank 33 back into the reactor 6. Thus the carrier portion of the liquid zinc from line 16 is evaporated in contact with the heat exchange fluid in the heat exchange loop.

The invention will still be more fully understood from the following calculated example.

EXAMPLE

In this example carried out in accordance with the schematic flow diagram shown in FIG. 2, 105 kg/hr of char containing 100 kg/hr of carbon are oxidized in contact with 676 kg/hr of zinc oxide at a temperature of 1300° K under a reactor pressure in the reactor 6 of 1.5 atmospheres (152 kPa). Under these conditions the carbon is completely converted to carbon monoxide and the zinc oxide is completely reduced to zinc. The reaction in the reactor 6 requires a heat input of 708,363 kg cal/hr 2,960 MJ/Hr). This heat is supplied by zinc vapor condensing inside of coil 21 within the reactor 6. The zinc is circulated through the heat exchange loop at a rate of 25.6 kg atoms per hour.

The zinc oxidizer 30 is operated at a temperature of 1500° K. Air is injected into this reactor in a quantity of supply oxygen with a 10% excess over the stoichiometrically required quantity. This is done to insure complete oxidation of the zinc. The exothermic reaction converting zinc into zinc oxide in the presence of the free oxygen generates 895,969 kg cal/hr (3,750 MJ/hr). Of this energy 750,000 kg cal/hr (3,140 Mj/hr) are transferred to the circulating zinc heat exchange fluid. The balance of the energy is utilized in heat exchanger 46 to evaporate the liquid zinc stream. Thus the heat exchanger 46 can be visualized to be arranged within the zinc oxidizer 30.

The reaction in the reactor 6 produces 8.25 kg mol/hr of carbon monoxide and 8.25 kg atom/hr of zinc. One kg atom/hr of zinc is introduced into the reactor via line 3.

Five kg atoms/hr of zinc vapor flow through line 47, whereas 3.311 kg atoms/hr of liquid zinc flow through line 27'' and are evaporated in heat exchanger 23 at a temperature of 1100° K under a pressure of 0.4 atmosphere (40.5 kPa). This zinc vapor in line 47' is then compressed by compressor 48 to 2 atmospheres (202 kPa), thus raising the temperature of the zinc vapor to 1450° K.

25.6 Kg atoms/hr of zinc flow in line 12, whereas 0.939 kg atom/hr of zinc is added to the vessel 50 via line 16 and 0.061 kg atom/hr of makeup zinc is added to the vessel 50 via line 51. The temperature of the zinc stream leaving coil 21 via line 13 is about 1350° K and the temperature and pressure of the zinc stream in line 37 are 1450° K and 30 atmospheres (3040 kPa), respectively.

Air is introduced into the zinc oxidizer 30 via line 8 at a temperature of 1400° K and at a rate corresponding to 4.57 kg mols/hr of oxygen and 17.2 kg mols/hr of nitrogen. 0.41 Kg mol/hr of oxygen and 17.2 mols/hr of nitrogen leave the zinc oxidizer 30 via line 10. The zinc oxidizer 30 is operated at a temperatue of 1500° K and under a pressure of 2 atmospheres (202 kPa). The temperature in the surge tank for the zinc oxide is about 1490° K.

The gaseous effluent leaving the reactor 6 via line 4 has a temperature of about 1300° K. In heat exchanger 23 this effluent is cooled to a temperature of 1130° K, and in condenser 24' having a duty of 127,000 kg cal/hr this gas stream is cooled to 1073° K. The gas/liquid separator 25' is under a pressure of 1.25 atmospheres (126 kPa). The gas leaving the separator 25' is further cooled by condenser 24'' having a duty of 118,000 kg cal/hr to a temperature of 773° K. The second gas/liquid separator 25'' is operated under a pressure of 1.15 atmospheres (116 kPa). The final water quench and wash unit 40 is operated under a pressure of 1.1 atmospheres (111 kPa). The liquid zinc stream leaving the second gas/liquid separator 25'' via line 27'' has a temperature of about 1773° K. In the following the material balance in kg/hr of the various streams shown in FIG. 2 is given.

MATERIAL BALANCE, kg/hr

| Stream No. | 1 Zinc Oxide Feed | 2 Char Feed | 3 Conveying Gas | 4 Gasifier Effluent | 5 Ash | 7 Zinc to Oxidizer | 8 Air | 9 Zinc Oxide Product | 10 Vent Gas | 12 Zinc Vapor Heat Transfer Medium | 13 Zinc Liquid |
|---|---|---|---|---|---|---|---|---|---|---|---|
| Carbon | | 100 | | | 1 | | | | | | |
| CO | | | | 231 | | | | | | | |
| Zn | | | 65 | 605 | | 543 | | | | 1676 | 1676 |
| ZnO | 676 | | | | 5 | | | 676 | | | |
| $N_2$ | | | | | | | 482 | | 482 | | |
| $O_2$ | | | | | | | 146 | | 131 | | |
| Ash | | 5 | | | 5 | | | | | | |
| Totals | 676 | 105 | 65 | 836 | 11 | 543 | 628 | 676 | 495 | 1676 | 1676 |

Thus zinc in this embodiment of the invention has the function of transporting the oxygen from the air into contact with the carbon source without adding nitrogen to the product and has the second function of transporting the heat generated by the zinc oxidation by indirect heat exchange back into the reactor where it is consumed in the endothermic reaction between carbon and zinc oxide. Furthermore, a portion of the zinc gas is effectively utilized as the carrier gas for transporting the zinc oxide back into the reactor.

Reasonable variations and modifications which will become apparent to those skilled in the art can be made in this invention without departing from the spirit and scope thereof.

I claim:

1. A process for the production of carbon monoxide which comprises a. introducing a solid carbon source and zinc oxide into a reactor equipped with first indirect heat exchange means, b. reacting said solid carbon source and said zinc oxide at a temperature of 1665° to 2800° F in said reactor to form a gas comprising carbon monoxide and zinc, c. withdrawing said gas from said reactor, d. separating zinc from said gas and recovering a carbon monoxide-comprising gas, e. contacting said zinc with an oxidizing agent to form a zinc oxidation mixture in a zinc oxidizer equipped with second indirect heat exchange means, f. reacting said zinc oxidation mixture to form zinc oxide, and g. circulating a heat exchange fluid selected from the group consisting of zinc, sodium, potassium and mixtures of sodium and potassium indirect heat exchange with the contacting of material in the zinc oxidizer to indirect heat exchange with the reacting of materials in said reactor to transfer a portion of the reaction heat developed in said zinc oxidizer into said reactor.

2. A process in accordance with claim 1 wherein said zinc oxide formed in said zinc oxidizer is withdrawn from said zinc oxidizer and introduced into said reactor.

3. A process in accordance with claim 1 wherein said heat exchanger fluid is circulated through said first and second heat exchange means under pressures of about 25 to about 50 psia for zinc as the heat exchanger fluid, about 25 to about 50 psia for sodium as the heat exchanger fluid, about 80 to about 130 psia for potassium as the heat exchanger fluid, and about 40 to about 100 psia for a 50/50 weight ratio mixture of potassium and sodium as the heat exchanger fluid.

4. A process in accordance with claim 1 wherein zinc is the heat exchange fluid.

5. A process in accordance with claim 1 wherein a third indirect heat exchange means having at least one first and at least one second path for flow of two fluids being in indirect heat exchange relationship with each other are provided for, wherein the heat exchange fluid flows from said second heat exchange means through said first path to said first heat exchange means and back from said first heat exchange means to said second heat exchange means in a loop flow, and wherein zinc separated from said gas flows through said second path of said third heat exchange means.

6. A process in accordance with claim 4 wherein said zinc leaving said second path of said third heat exchange means is a zinc vapor stream, wherein said zinc vapor stream is split into a first, a second and a third portion, wherein said first portion is introduced into said zinc oxidizer and into contact with said oxidizing agent, wherein said second portion of said zinc vapor stream is introduced as a carrier gas into a withdrawal line for withdrawal of zinc oxide from said zinc oxidizer and for carrying this zinc oxide into the reactor, and wherein said third portion of said zinc vapor stream is introduced into the lower portion of said reactor as a fluidizing gas for fluidizing the reacting mixture comprising zinc oxide and a solid carbon source.

7. A process in accordance with claim 2 wherein said heat exchange fluid is zinc, wherein the zinc in said gas is separated from said gas by condensing it and removing liquid zinc from the carbon monoxide-comprising gas, wherein a first portion of said liquid zinc separated from said gas is introduced into the second heat exchange means together with circulating zinc from said first heat exchange means, wherein a second portion of said liquid zinc separated from said gas is introduced into the zinc oxidizer and into contact with the oxidizing agent, wherein a zinc side stream is withdrawn from the circulating zinc leaving the second heat exchange means, and wherein at least a portion of said zinc side stream is admixed with the solid zinc oxide produced in the zinc oxidizer and to transfer said zinc oxide to said reactor.

8. A process in accordance with claim 6 wherein a zinc makeup stream is introduced into the second heat exchange means together with the circulating zinc and with said second portion of said liquid zinc separated from said gas.

* * * * *